US007082674B2

(12) United States Patent
Mori et al.

(10) Patent No.: US 7,082,674 B2
(45) Date of Patent: Aug. 1, 2006

(54) METHOD FOR WINDING A SINGLE COIL OF A COIL UNIT FOR A LINEAR MOTOR

(75) Inventors: Hidehiko Mori, Hachiouji (JP); Yasushi Koyanagawa, Isehara (JP); Yoshiyuki Tomita, Hiratsuka (JP)

(73) Assignee: Sumitomo Heavy Industries, Ltd., Tokyo (JP)

( * ) Notice: Subject to any disclaimer, the term of this patent is extended or adjusted under 35 U.S.C. 154(b) by 242 days.

(21) Appl. No.: 10/678,134

(22) Filed: Oct. 6, 2003

(65) Prior Publication Data

US 2004/0064935 A1 Apr. 8, 2004

Related U.S. Application Data

(62) Division of application No. 10/083,686, filed on Feb. 27, 2002, now Pat. No. 6,644,584.

(51) Int. Cl.
*H01F 7/06* (2006.01)

(52) U.S. Cl. ..... 29/605; 29/602.1; 29/606; 242/437.3; 242/437.4; 242/443; 242/445.1; 336/212; 336/234

(58) Field of Classification Search ..... 29/602.1, 29/605, 606; 242/437.3, 437, 443, 445.1, 242/437.4; 336/212, 234
See application file for complete search history.

(56) References Cited

U.S. PATENT DOCUMENTS 3,701,489 A * 10/1972 Goldsworthy et al. ... 242/437.2
5,470,414 A * 11/1995 Harris et al. ..... 156/174

FOREIGN PATENT DOCUMENTS

JP 61194803 A * 8/1986
JP 11-273579 10/1999
JP 2001-067955 3/2001

OTHER PUBLICATIONS

"150-kW experimental superconducting permanent-magnet motor"; Tixador, P.; Simon, F.; Daffix, H.; Deleglise, M.; Applied Superconductivity, IEEE Transactions on vol. 9, Issue 2, Part 1, Jun. 1999; pp. 1205-1208.*
Japanese Patent No. 2001-067955, Abstract only.
Japanese Patent No. 11-273579, Abstract only.

* cited by examiner

*Primary Examiner*—Paul D. Kim
(74) *Attorney, Agent, or Firm*—Arent Fox PLLC

(57) ABSTRACT

A rectangular single coil of a coil unit for a linear motor is fabracated by winding a single conductive wire. A winding former having locks for a conductive wire at positions corresponding to vertices of the rectangular single coil is rotated by 180 degrees about an X-axis, by 180 degrees about a Y-axis, alternately by first and second rotating mechanisms. Thereby, a single conductive wire fed out in the direction of a Z-axis from a conductive wire feeding out machine is wound while locked to the locks of the winding former in succession.

1 Claim, 10 Drawing Sheets

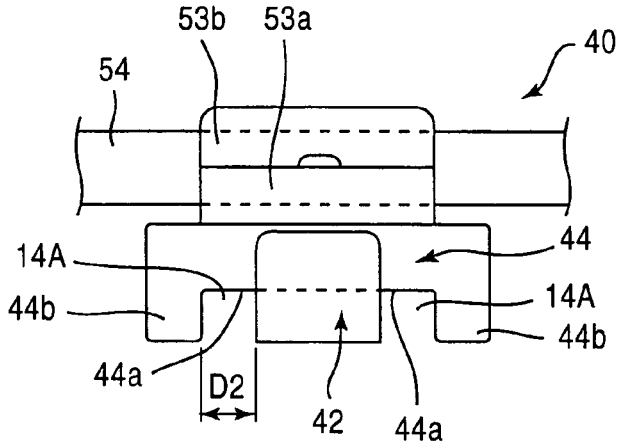
FIG.2A
FIG.2B
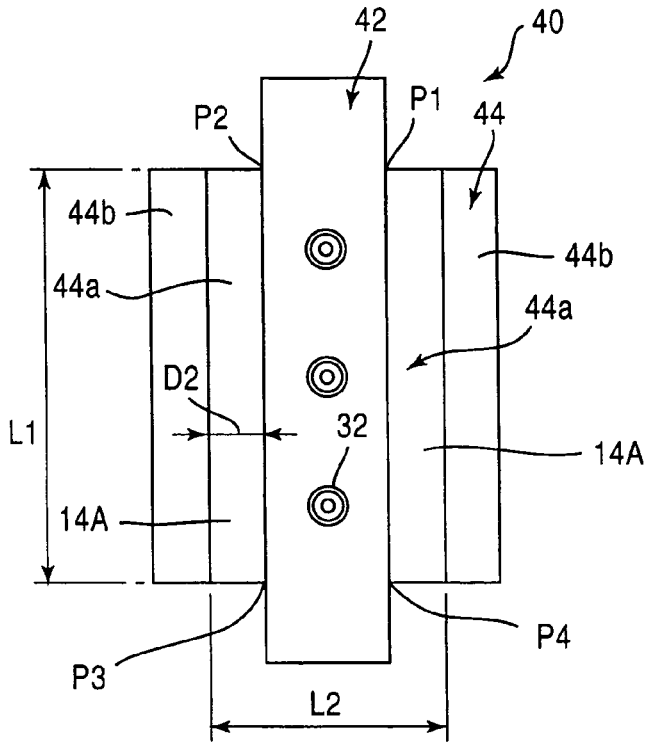
FIG.2C
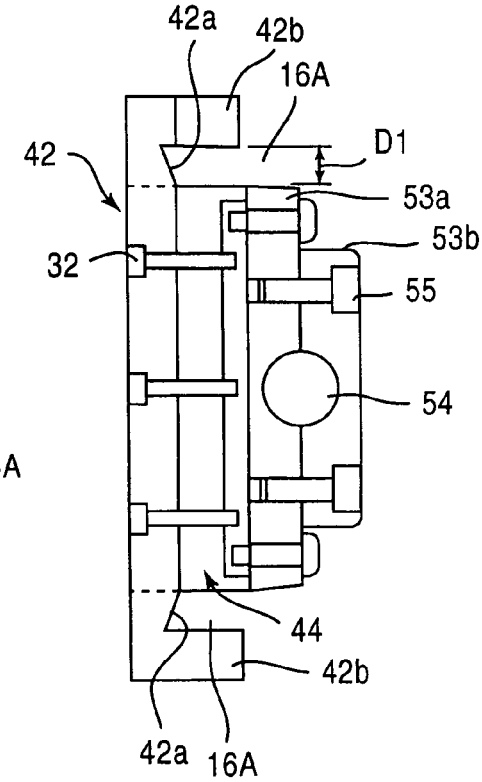

P1→P2
P2→P3
P3→P4
P4→P1

Z
W
X
Y
P1
P2
P3
P4
14f
14s
16f
16s

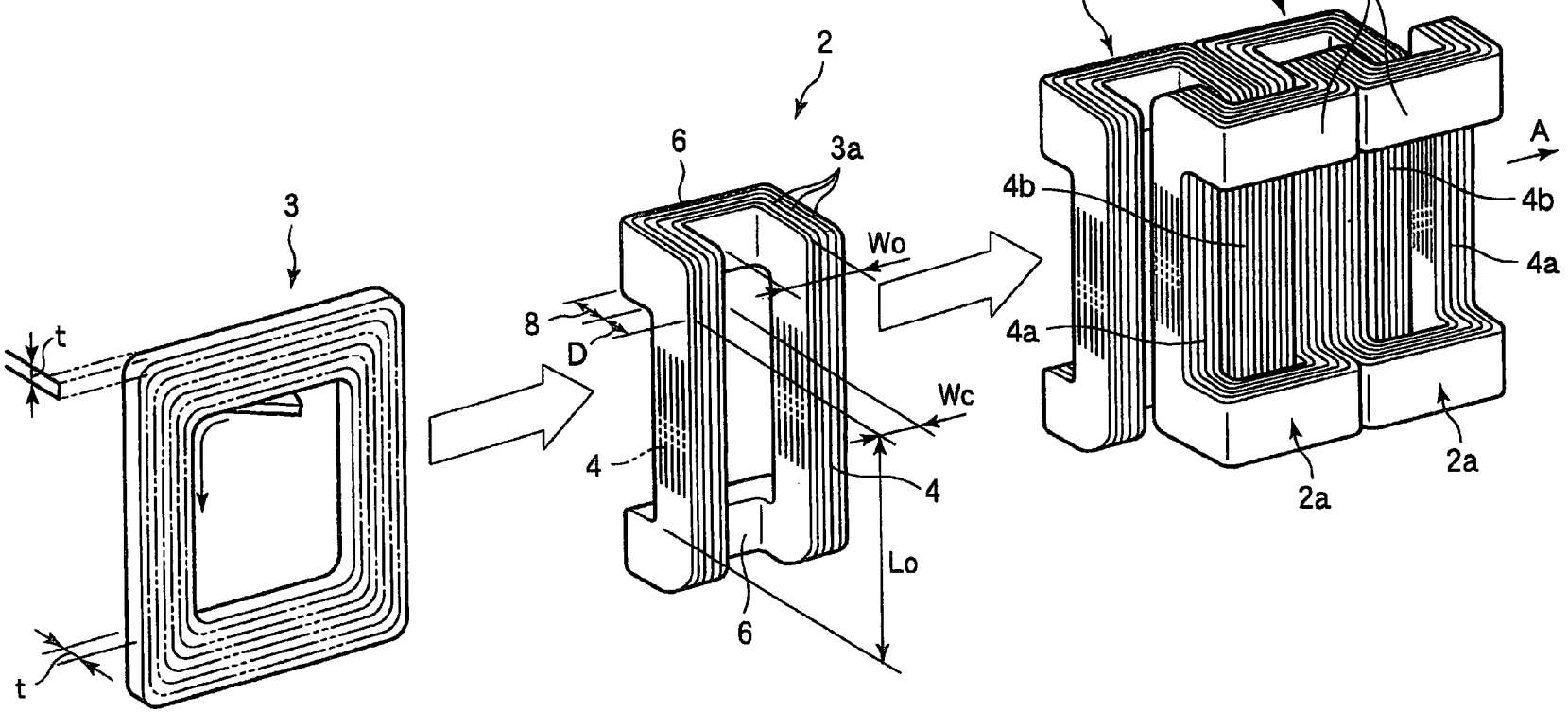
(PRIOR ART) FIG.10C
(PRIOR ART) FIG.10B
(PRIOR ART) FIG.10A

METHOD FOR WINDING A SINGLE COIL OF A COIL UNIT FOR A LINEAR MOTOR

This is a division of application Ser. No. 10/083,686 filed Feb. 27, 2002, now U.S. Pat. No. 6,644,584.

BACKGROUND OF THE INVENTION

1. Field of the Invention

The invention relates to a technology for fabricating a coil unit for a linear motor or a single coil thereof through line material (conductive wire) winding.

2. Description of the Prior Art

Linear motors are simple in structure, low in parts count, and capable of driving their moving bodies linearly even with precision and speed. Accordingly, the linear motors find wide use as linear drive units or positioning devices in any fields such as exposure devices for semiconductor manufacturing and high precision machine tools.

In general, a linear motor is composed of a magnetic pole unit having magnets and a coil unit having coils. Either one of the units is fixed to a base as a fixed body, and the other is coupled to a moving table or the like as a moving body. The magnetic pole unit and the coil unit are opposed to each other with a constant gap therebetween. When magnetic force is created between the two units, this magnetic force functions as thrust to drive the moving body without contact while maintaining the above-mentioned gap.

For one form of the linear motor, a direct-current linear motor of multi-pole/multi-phase type has been disclosed. In this linear motor, a magnet unit is composed of a plurality of N/S poles that are arranged so that adjoining poles have opposite polarities. Moreover, a plurality of single coils are connected to form a single coil unit as a whole.

Each of the single coils constituting the coil unit has the overall shape of a nearly rectangular ring. Among the four sides of this rectangular, the two sides opposed to each other across the traveling direction function as effective conductors which contribute to the thrust production in a moving body of a linear motor. The other two sides make connecting conductors for connecting the effective conductors. The connecting conductors do not particularly contribute to the thrust production in the linear motor.

Suppose that the magnetic flux density acting on the effective conductors is B (T), the current flowing through the effective conductors is I (A), and the length of the effective conductors is L (m). The thrust F (N) of the linear motor is given by F=BIL. Then, assuming that the number of turns of each single coil is n, F is represented as F=BniL. Where i is the per-wire current.

It can be seen from above that at given dimensions or specifications of the component members, the maximization of the thrust F requires that each single coil be increased in the number of turns.

Generally, a wire can be wound a plurality of times to form a coil by using the method of: preparing a so-called "winding former" consisting of a male piece and a female piece in conformity with the shape of the coil; coupling these pieces to form a space for the wire to be wound on; and winding the wire around the winding former (over and over) sequentially.

For the case of a coil unit for a linear motor, however, the single coils are arranged closely in a traveling direction. This generally requires that each single coil have its connecting conductors bent sharply from the effective conductors. Therefore, the simple method of winding as described above has the problem that the "bents" are extremely hard to form by means of the winding former's configuration alone.

Now, brief description will be given of a technology according to Japanese Patent Laid Open No. 2001-67955. The description is given by way of example for the sake of a proper understanding of the foregoing problem to be solved by the present invention or the validity of the present invention.

This technology uses a single coil 2 of saddle shape as shown in (b) of FIG. 10, formed by sharply bending connecting conductors 6 at approximately 90 degrees with respect to effective conductors 4. As shown in (c) of FIG. 10, single coils 2 (2*a*, 2*b*) of such saddle shape are closely arranged in order with little gap therebetween. Here, the single coils 2*a* having their connecting conductors 6 bent to the right with respect to the traveling direction A and the single coils 2*b* having their connecting conductors bent to the left get into between the effective conductors 4*a*, 4*b* of the other parties each other. The single coils 2 are interconnected according to the specifications of a coil unit 10, thereby forming a single coil unit for one linear motor.

When the single coils 2 are driven with a three-phase current, currents having 120-degree differences in phase are passed through adjoining single coils 2 to make a U-V-W three-phase coil unit. Each single pole, a constituting unit of a linear motor, is defined as a part from one N/S pole of the magnet array to a next N/S pole. The number of the single coils 2 corresponding thereto is three; or the U, V, and W phases (per pole).

Conventionally available coil units for a linear motor are formed by combining two types of single coils, more specifically, ones having their connecting conductors bent to the right or left with respect to a traveling direction and ones having no bent. It is characteristic of the coil units to be seen the three phases of coils in a cross section perpendicular to the pole pitch direction (coincident with the direction A). In contrast, this coil unit 10 includes a single type of single coils 2 alone, which are simply distributed to either side and combined with each other to form the coil unit 10. This means a major characteristic that only two phases of single coils 2 appear in that cross section. These single coils 2 or the coil unit 10 successively offers a number of highly beneficial advantages for reasons including the following. That is, the coil unit 10 is formed with the single coil 2 of one type alone; the length Wo of the connecting conductors 6 is made as short as possible with respect to the length Lo of the effective conductors 4; and the effective conductors 4 are arranged with no gap formed therebetween.

Nevertheless, each single coil 2 in this technology is configured so that a pair of connecting conductor 6 bend at approximately 90 degrees "in the same direction" with respect to the effective conductors 4. The single coils 2 of such configuration are extremely hard to fabricate by "the method of winding by using a conventional winding former," in fact.

Even if managed to wind, it is extremely difficult to secure the wire at a proper winding angle to the winding former in forming each of the pair of connecting conductors. If the winding tension is increased to prevent the production of slack and the like, a desired coil shape cannot be obtained due to accumulated twists. Besides, the wire density (space factor) varies from place to place, resulting in poor magnetic performance. In particular, when the number of turns n of each single coil is increased for the sake of greater thrust, each side of the rectangular becomes greater in cross-sectional area. This eventually precludes the winding itself.

On that account, the Japanese Patent Laid Open No. 2001-67955 has also proposed a technology of: "initially winding a rectangular wire of t in thickness a plurality of times within the same plane to form a rectangular coil sheet 3; bending a pair of connecting conductors 6 thereof at approximately 90 degrees in the same direction with respect to the effective conductors 4 to form a coil sheet 3*a* in a U-shape; and preparing a plurality of such U-shaped coil sheets 3*a* having slight differences in width and bent positions, and laminating the same into one single coil 2" as shown in (a) of FIG. 10.

Nevertheless, there is no denying that the fabrication of a single coil by laminating a plurality of coil sheets having slight differences in width and bent positions is disadvantageous in terms of cost and flexibility for changing design.

SUMMARY OF THE INVENTION

The present invention has been achieved in view of the foregoing problems. It is thus an object of the present invention to provide a technology for allowing even a type (form) of a single coil having a pair of connecting conductors bent sharply in the same direction with respect to effective conductors to be fabricated from a single wire through winding, thereby providing a low-cost easy-to-redesign single coil and a coil unit utilizing the same.

The foregoing object of the present invention has been achieved by the provision of a device for winding a single coil of a coil unit for a linear motor, the single coil having a shape of a nearly rectangular ring as a whole, the device comprising: a conductive wire feeding out mechanism for feeding out a conductive wire serving as material for the single coil in a direction of a Z-axis, where a direction for the conductive wire to be fed out is defined as the Z-axis, and axes crossing at right angles within a plane perpendicular to the Z-axis are defined as X- and Y-axes, respectively; a winding former positioned with its center at a point of origin on the X-and Y-axes, the winding former having locks for the conductive wire at positions corresponding to vertices of the rectangle and functioning as a base in winding the conductive wire into a nearly rectangular shape; and a first rotating mechanism and a second rotating mechanism for allowing the winding former to rotate about the X and Y, two axes, respectively. Here, the first and second rotating mechanisms repeat rotating the winding former by 180 degrees about the X-axis and by 180 degrees about the Y-axis alternately so that the single conductive wire fed from the conductive wire feeding out mechanism in the direction of the Z-axis is wound around the winding former while being locked to the locks in succession (a first aspect of the invention).

In the process of development, the present invention has started with a contrivance to the configuration of the winding former, and then taken account of the technique of winding while slightly tilting and returning a winding former during the winding. Nevertheless, in the conventional method of winging a wire around a winding former of predetermined shape over and over basically in "the same direction" (the method for winding a wire by continuously rotating a winding former in one direction about an axis orthogonal to the wire), component forces off the direction of the Z-axis occurred during the winding as the shape of the coil to be wound became deformed, i.e., got off from a simple cylinder. Besides, it was impossible to prevent the component forces from accumulating with winding. Eventually, accumulated twists occurred inevitably with the result of seriously disturbed winding which could not be contained in an intended shape.

Then, the present inventors have made radical reconsideration of the winding method itself and have invented a technology of winding while rotating a winding former within 180 degrees about two axes "alternately."

According to this technology, the following beneficial effects are obtained.

(1) In winding whichever effective conductor or whichever connecting conductor, the wire is always locked to one of the locks when wound so as to bend at 90 degrees around the lock. As a result, despite the irregular-shape coil, the wire can be easily wound in order at both the effective conductors and the connecting conductors without increasing the winding tension excessively.

(2) The first and second rotating mechanisms of the apparatus for winding rotate the winding former always in the same direction, while the winding former is thereby reversed with respect to the feeding direction of the wire about the X-axis and the Y-axis alternately. In view of the rotation of the winding former with respect to the wire, the following four modes are repeated:

1) A forward rotation by 180 degrees about an axis parallel to the connecting conductors;

2) A forward rotation by 180 degrees about an axis parallel to the effective conductors;

3) A reverse rotation by 180 degrees about an axis parallel to the connecting conductors; and 4) A reverse rotation by 180 degrees about an axis parallel to the effective conductors.

After a single (one) round of winding, the wire W twisted by the forward rotations is fully restored by the reverse rotations. This precludes torsion accumulation regardless of the number of wind.

(3) In the winding method according to the present invention, the wire is firmly locked to each lock with torsion. Conversely, the torsion occurring at each lock basically concludes near that lock. Therefore, the occurrence of torsion is limited to the vicinities of the locks alone. The result is that the winding of the wire on each side is effected by simply "extending" the wire from one lock to another through rotation about the next axis (the axis orthogonal to the side for the wire to be extended across). Accordingly, new winding is always performed on a plane containing the Z-axis and the effective conductors, or on a plane containing the Z-axis and the connecting conductors, with little production of side force (torsional stress). As a result, the wire between locks suffers little torsional stress. Torsion occurring on a given lock hardly propagates to the next lock.

Besides, even when it propagates slightly, this torsional stress is cancelled by the above-described effect (2) upon the completion of a single round of winding.

Moreover, according to the present invention, design changes to the single coil can be made by simply modifying the size and/or shape of the winding former or the number of turns. This facilitates designing of extreme flexibility as compared to the structure in which a plurality of coil sheets having different sizes are laminated.

Furthermore, according to the present invention, the wire may use one having a circular cross section, or so-called general-purpose wire, as is. This wire is easily obtainable, which allows a further reduction in delivery time and in costs.

In the present invention, the conductive wire feeding out mechanism for feeding the wire to the winding former is not particularly limited to any concrete configuration. The first and second rotating mechanisms are not particularly limited to any concrete drive structures, either. In some cases, these first and second rotating mechanisms may use ones for rotating the winding former manually.

In addition, the winding former is not particularly limited to any concrete configuration, either. For example, this winding former may comprise a first piece and a second piece detachably overlapped crisscross. Here, the first piece is accommodated between the sides to be the effective conductors. The first piece has a pair of first winding parts extended beyond the two sides to be the connecting conductors, and the connecting conductors are wound on the first winding parts, respectively. The second piece is accommodated between the sides to be the connecting conductors. The second piece has a pair of second winding parts extended beyond the two sides to be the effective conductors. The effective conductors are wound on the second winding parts, respectively. Four intersections formed by the first and second pieces overlapped crisscross function as the locks for a wire, respectively. In this configuration, it is possible to obtain a winding former that can favorably achieve the object of the present invention with a simple structure.

When the winding former is configured thus, the first winding parts of the first piece and the second winding parts of the second piece may have flanges for forming the winding of the wire, protruded from the respective ends toward the counter pieces. The result is that the wire is would while guided by the flanges. This facilitates shaping the effective conductors or the connecting conductors into intended cross-sectional shapes.

In addition, the first winding parts of the first piece may be sloped away from the second piece toward ends of the first winding parts. When a plurality of single coils wound by this winding former are arranged to form a coil unit, the space not contributing to producing a thrust can be reduced further. Then, the per-volume thrust of the coil unit can be increased accordingly.

Speeds of rotation of the winding former by the first and second rotating mechanisms are desirably controlled so that feeding out speed or feeding out tension of the conductive wire fed from the conductive wire feeding out mechanism becomes constant. This allows more uniform, less twisted winding.

Here, the conductive wire feeding out mechanism desirably includes a feeding position control mechanism for changing a position for itself to feed out the conductive wire toward the winding former at least along the X-axis, and changes the position to feed out the conductive wire at least along the X-axis in synchronization with the state of rotation of the winding former by the first and second rotating mechanisms. When this control, i.e., the control of changing the wire-feeding position (coordinate) in synchronization with the state of rotation of the winding former is exercised with precision, it becomes possible to wind the wire in order thread by thread as if to form a simple cylindrical coil.

Incidentally, when the modification of the feeding position is exercised in the direction of the X-axis alone, the winding state of the effective conductors can be rendered in order if the effective conductors are wound by the rotation of the winding former about the X-axis. If the modification/control is exercised even in the direction of the Y-axis, the winding state of the connecting conductors also becomes controllable.

Now, the present invention may be viewed in light of "a method for winding a single coil." Specifically, the invention provides a method for winding a single coil of a coil unit for a linear motor, the single coil having a shape of a nearly rectangular ring as a whole, two opposed sides of the rectangle functioning as effective conductors which contribute to producing a thrust in a moving body of a linear motor, the other two opposed sides of the rectangle functioning as connecting conductors for connecting the effective conductors, the method comprising: the step of feeding out a conductive wire serving as material for the single coil in a direction of a Z-axis, a winding former being positioned with its center at a point of origin on X- and Y-axes, the winding former having locks for the conductive wire at positions corresponding to vertices of the rectangle and functioning as a base in winding the conductive wire into the nearly rectangular shape, where a direction for the conductive wire to be fed out is defined as the Z-axis, and axes crossing at right angles within a plane perpendicular to the Z-axis are defined as X- and Y-axes, respectively; the first rotating step of rotating the winding former by 180 degrees about the X-axis while locking a single conductive wire fed in the direction of the Z-axis to one of the locks; the second rotating step of rotating the winding former by 180 degrees about the Y-axis after the conductive wire is rendered lockable to the next lock in the first rotating step; the third rotating step of rotating the winding former by 180 degrees about the X-axis after the conductive wire is rendered lockable to the next lock in the second rotating step; and the fourth rotating step of rotating the winding former by 180 degrees about the Y-axis after the conductive wire is rendered lockable to the next lock in the third rotating step. The first through fourth rotating steps are repeated subsequently to wind the conductive wire around the winding former successively.

According to the present invention, a method for increasing the wire density of the single coil thus wound around the winding former and forming the single coil further may be provided so that a plurality of such single coils can be arranged at a regular pitch more orderly in forming a coil unit. The method comprises the steps of: loading the single coil into a forming tool, and temporarily fastening the forming tool with the single coil wound around the winding former; passing a predetermined current through the conductive wire to cause heat so that the conductive wire rises in temperature until it enters a plastic range; and fastening the forming tool further from the temporarily-fastened state to shape the conductive wire in the plastic range into predetermined configuration.

The present invention may also relate to a method for fabricating a coil unit from single coils shaped thus. More specifically, the method comprises the steps of: cooling the single coil formed, and then removing the forming tool loaded; preparing a plurality of single coils removed of forming tools, loading the same into a forming device for a unit, and fastening the same; connecting the plurality of single coils to each other according to a specification of the coil unit; and fixing the connecting conductors of the individual single coils with an adhesive.

Furthermore, the present invention may relate to a method for shaping the wound single coils and then shaping the coil unit. More specifically, the method comprises the steps of: releasing the single coil from the winding former; preparing a plurality of single coils released from winding formers, loading the same into a first forming device for a unit, and temporarily fastening the same; connecting the plurality of single coils to each other according to a specification of the coil unit; loading the plurality of connected single coils into a second forming device along with the first forming device, and temporarily fastening the same; passing a predetermined current through the conductive wires of the respective single coils to cause heat so that the conductive wires rise in temperature until they enter a plastic range; fastening the first and second forming devices further from the temporarily-fastened state to form the conductive wires in the plastic range into predetermined configuration; and, after the forming, fitting a forming tool for compression.

BRIEF DESCRIPTION OF THE DRAWINGS

FIGS. 2A–2C illustrate a front view, a plan view, and a longitudinal sectional view, respectively, of a winding former in the above-mentioned embodiment;

FIGS. 10A–10C illustrate perspective views sequentially showing the conventionally known steps of fabricating a coil unit for a linear motor.

DETAILED DESCRIPTION OF THE PREFERRED EMBODIMENTS

Hereinafter, preferred embodiments of the present invention will be described in detail with reference to the accompanying drawings.

Figure 1:
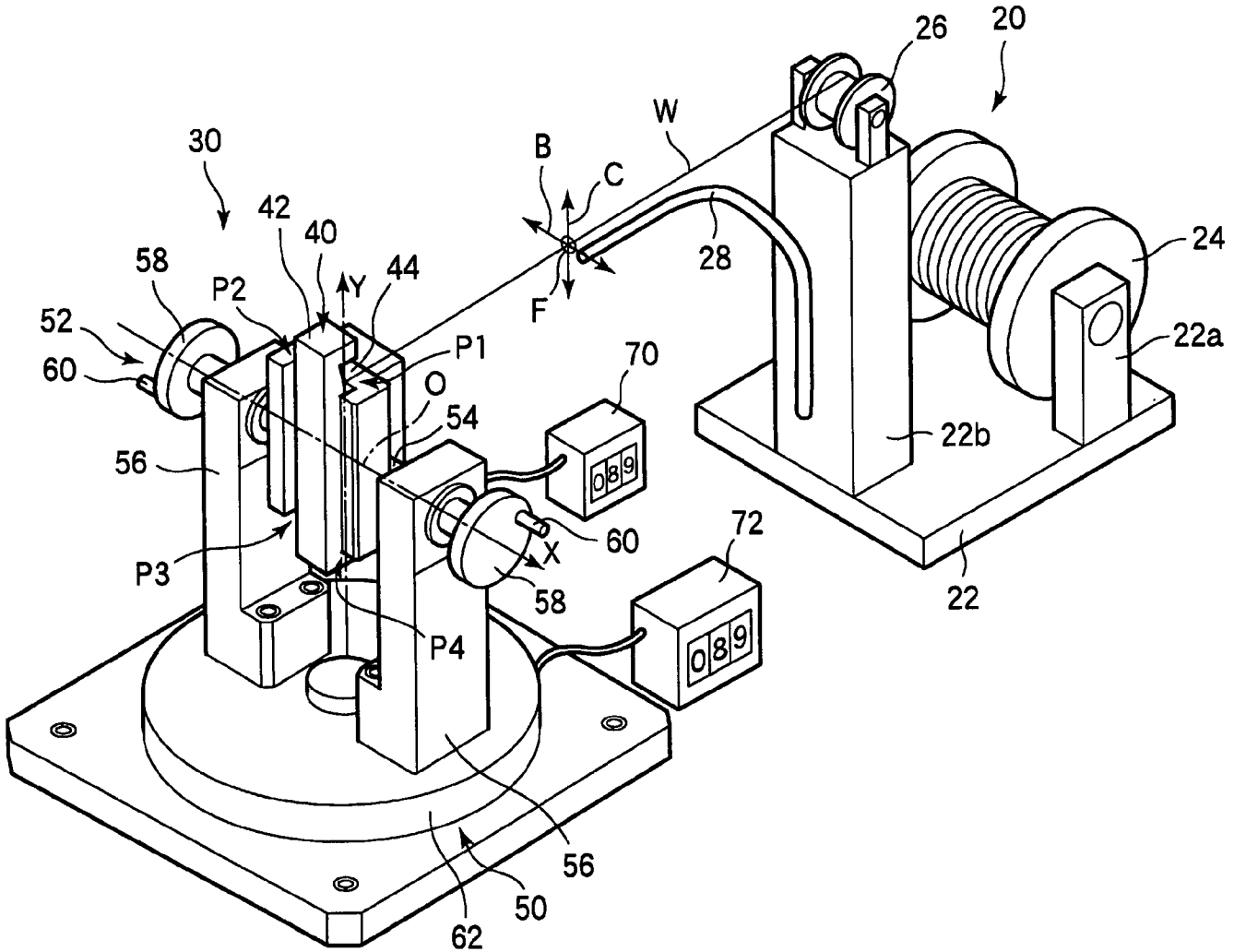
FIG. 1 is a perspective view showing the outline of a winding device for a single coil of a coil unit for a linear motor according to a first embodiment of the present invention.

FIG. 1 schematically shows a winding device for a single coil of a coil unit for a linear motor according to the present invention.

A single coil 12 to be wound by this winding device basically has the same fundamental shape as that of the single coil 2 according to Japanese Patent Application Laid Open No. 2001-67955 which has been described in conjunction with FIGS. 10A–10C. Thus, in the following description, the parts having identical or similar functions to those of the single coil 2 will be designated by 10-odd numerals having the same last one figures. That is, the entire single coil 12 is shaped like a generally rectangular ring. Opposed two sides of this rectangular function as effective conductors 14, which contribute to producing a thrust in the moving body of a linear motor. The other two opposed sides function as connecting conductors 16 for connecting the effective conductors 14.

FIG. 1 shows a state where the single coil 12 starts to be wound up. The direction for the material of the single coil 12, or a conductive wire W, to be fed out is defined as the Z-axis. Axes that cross at right angles within a plane perpendicular to the Z-axis are defined as the X- and Y-axes, respectively. Here, for convenience's sake, the horizontal axis (the center axis of rotation of the sides that make the connecting conductors 16) is defined as the X-axis, and the vertical axis (the center axis of rotation of the sides that make the effective conductors 14) the Y-axis.

This winding device is composed of a conductive wire feeding out machine (conductive wire feeding out mechanism) 20 and a winding machine 30. The conductive wire feeding out machine feeds out the conductive wire W in the direction of the Z-axis. The winding machine 30 winds the conductive wire W fed out.

Initially, description will be given of the configuration of the conductive wire feeding out machine 20.

This conductive wire feeding out machine 20 comprises a base 22, a coil bobbin 24, a guide roller 26, and a guide arm 28.

A pair of first support posts 22*a* and a second support post 22*b* are provided vertically (in the direction of the Y-axis) on the base 22. The coil bobbin 24 is supported by the first support posts 22*a* rotatably about the X-axis. The coil bobbin 24 re-coils and feeds out the conductive wire W that is wound and held. The guide roller 26 is supported at the top of the second support post 22*b* rotatably about the X-axis. The guide roller 26 changes the feeding out direction of the conductive wire W fed from the coil bobbin 24 to the Z-axis direction. The guide arm 28 is mounted on a side of the second support post 22*b*. The guide arm 28 settles and determines the position (coordinates) of the conductive wire W to be fed out.

Meanwhile, the winding machine 30 is composed chiefly of a winding former 40 and first and second rotating mechanisms 50 and 52.

The winding former 40 is positioned and arranged with its center at a point of origin O on the X- and Y-axes mentioned above. This winding former 40 has locks P1–P4 for the conductive wire W at positions corresponding to vertices of the rectangular of the single coil 12. The winding former 40 functions as a base in winding the conductive wire W into a rectangular shape through its own rotation.

FIGS. 2A–2C illustrate a specific structure of the winding former 40. The winding former 40 comprises a first piece 42 and a second piece 44.

The first piece 42 is arranged inside of two sides 14A that will be the effective conductors 14. This first piece 42 has a pair of first winding parts 42*a* which are extended beyond two sides 16A that will be the connecting conductors 16. The connecting conductors 16 are wound on the first winding parts 42*a*, respectively.

The second piece 44 is arranged inside of the two sides 16A that will be the effective conductors 16. This second piece 44 has a pair of second winding parts 44*a* which are extended beyond the two sides 14A that will be the effective conductors 14. The effective conductors 14 are wound on the second winding parts 44*a*, respectively.

The first winding parts 42*a* of the first piece 42 are formed as sloped such that is departs from the second piece toward the ends of the first winding parts 42*a*. This configuration aims to maintain favorable accommodation between the connecting conductors 16 of a plurality of single coils 12 when the single coils 12 are arranged to form a coil unit for a linear motor (to be described later in conjunction with FIGS. 8A–8B).

The first winding parts 42*a* of the first piece 42 and the second winding parts 44*a* of the second piece 44 have flanges 42*b* and 44*b* at their respective ends. The flanges 42*b* and 44*b* are protruded toward the counter pieces, respectively. The presence of the flanges 42*b* shapes the winding of the conductive wire W at the connecting conductors 16, whereby the connecting conductors 16 are maintained generally rectangular in section. The presence of the flanges 44*b* shapes the winding of the conductive wire W at the effective conductors 14, whereby the effective conductors 14 are maintained generally rectangular in section.

The first piece 42 and the second piece 44 are detachably overlapped crisscross via a plurality of bolts 32. When overlapped crisscross, the first winding parts 42*a* of the first piece 42 and the second winding part 44*a* of the second piece 44 extend beyond the respective counter piece 44 and 42. The four intersections formed thus function as the locks P1–P4 for the conductive wire W.

The first rotating mechanism 50 is composed of a shaft 54, a pair of third support posts 56 (FIG. 1), disks 58 integrated with the shaft 54, and handles 60 for rotating the disks 58. The shaft 54 is arranged along the X-axis and integrated with the second pieces 44 of the winding former 40 via pressing bodies 53*a* and 53*b* and bolts 55. This shaft 54 is rotatably supported by the third support posts 56. That is, the present embodiment adopts the constitution for manually rotating the winding former 40 about the X-axis.

The second rotating mechanism 52 is composed chiefly of a rotation base 62 which allows rotation of the winding former 40 and the entire first rotating mechanism 50 about the Y-axis. This rotation base 62 is manually rotated with the handles 60, the disks 58, and the third support posts 56 of the first rotating mechanism 50. Thus, the handles 60, the disks 58, and the third support posts 56 constitute a part of the first rotating mechanism 50 and simultaneously serve as a part of the second rotating mechanism 52.

In the drawings, reference numerals 70 and 72 represent counters for counting and displaying numbers of rotations of the first rotating mechanism 50 and the second rotating mechanism 52, respectively.

This embodiment adopts the constitution of manually rotating the winding former 40 in this way. Needless to say, the disks 58 and the rotation base 62 may be electrically rotated by using not-shown motors. In this case, the rotations of the motors can be controlled so that the feeding out speed S of the conductive wire W from the conductive wire feeding out machine 20 becomes constant. This makes it possible to maintain the tension Te of the conductive wire W approximately constant for the sake of uniform, smooth winding. Since the feeding out speed S of the conductive wire W corresponds to a rotation speed of the guide roller 26, the speed S can be detected, for example, by a rotation speed sensor (not shown) added to this guide roller 26. It is obvious that when a torque sensor capable of detecting the feeding out tension Te of the conductive wire W itself (or a tension sensor mechanism: a variety of publicly-known configurations for detecting elastic deformation or the like may be adopted) is provided, the motor for rotating the disks 58 of the first rotating mechanism 50 and/or the rotation base 62 of the second rotating mechanism 52 can be controlled so that the feeding out tension Te detected becomes constant.

Moreover, in this embodiment, the feeding out position (coordinate) F of the conductive wire W fed out from the conductive wire feeding out machine 20 is maintained stationary by the guide arm 28. This constitution may be extended so that the feeding out position F can be changed in the direction of the X-axis (and the direction of the Y-axis) (see the arrows B and C in FIG. 1). In this case, the feeding out position F can be changed and controlled in synchronization with the rotation of the winding former 40 (including the concept of the accumulated number of rotations). This allows the wire W to be wound as if around a simple cylinder successively (as in regular winding).

Here, when the feeding out position F is controlled in the direction of the X-axis, it is possible to tighten the winding of the effective conductors 14, in particular, which directly contribute to the production of magnetic force. In addition, when a configuration capable of changing the feeding out position F even in the direction of the Y-axis is adopted, favorable winding is also maintained at the connecting conductors 16.

Next, description will be given of the operation of this winding device.

Figures 3A, 3B, 3C, 3D:
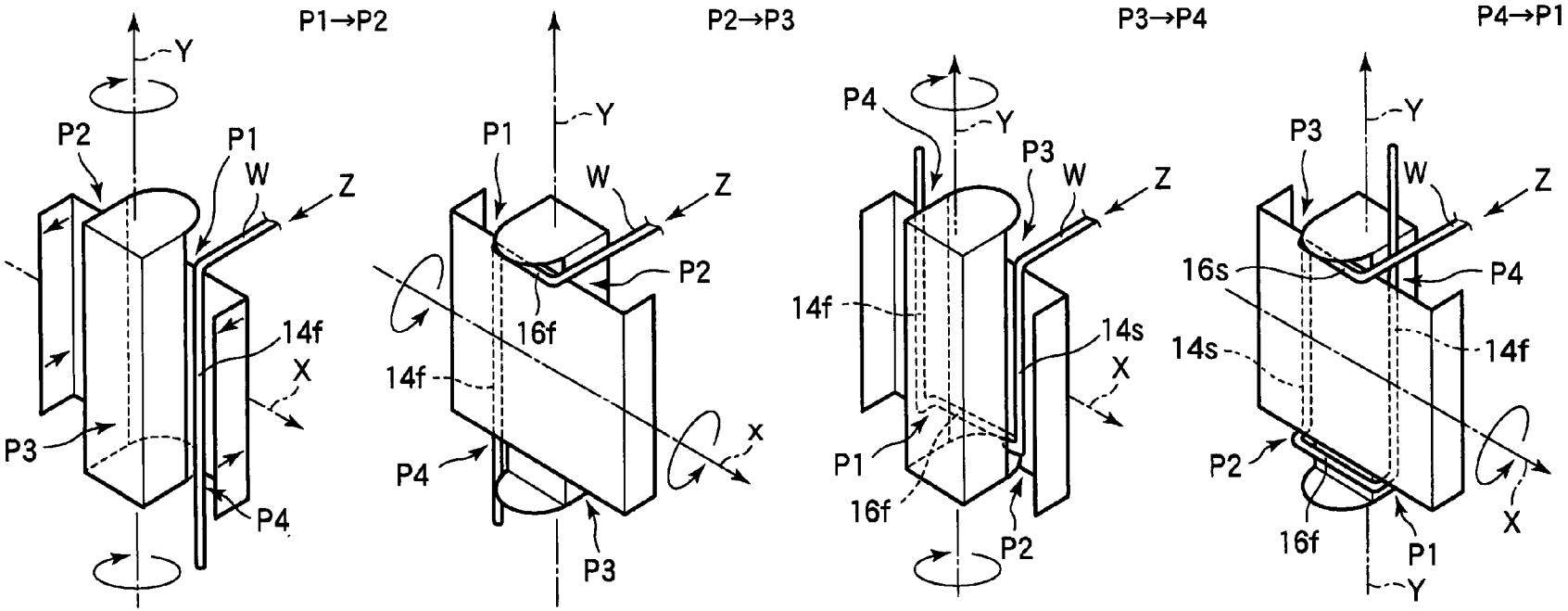
FIGS. 3A–3D are perspective views showing the steps of winding a wire in the above-mentioned embodiment.

Referring to FIGS. 1 and 3A–3D, the conductive wire W that is fed out in the direction of the Z-axis through the coil bobbin 24, the guide roller 26, and the guide arm 28 is bent around the lock P1 of the winding former 40, into an initial state where a first effective conductor 14*f* is formed as shown in FIG. 3A. To form this initial state, the conductive wire W itself may be bent directly. The rotation of the winding former 40 about the X-axis may be combined.

In this state, the winding former 40 is rotated by 180 degrees about the Y-axis by the second rotating mechanism 52. This rotation first causes torsion at the lock P1, whereby the conductive wire W is firmly locked to the lock P1. With this lock P1 as a start point (or origin), the winding former 40 is rotated to the lock P2, or equivalently the end point, along the conductive wire W that is fed newly. This stretches a first connecting conductor 16*f* as shown in FIG. 3B. This "stretch" is effected so that the winding former 40 "aligns to" the newly-fed, stress-free conductive wire W. Therefore, little side force (torsional stress) occurs in the plane that includes the Z-axis and the connecting conductor 16. That is, despite an irregular-shape coil, the torsion occurring at the lock P1 hardly propagates to the next lock P2.

After the state in FIG. 3B is formed, the winding former 40 rotates by 180 degrees about the X-axis. This rotation causes torsion at the lock P2 this time, whereby the conductive wire W is firmly locked to the lock P2. With this lock P2 as the start point (or origin), the winding former 40 is rotated along the conductive wire W up to the lock P3, or equivalently the new end point. This stretches a next effective conductor 14*s* as shown in FIG. 3C. This "stretch" is also effected so that the winding former 40 "aligns to" the newly-fed, stress-free conductive wire W. Therefore, little side force (torsional stress) occurs in the plane that includes the Z-axis and the effective conductors 14. That is, the torsion occurring at the lock P2 hardly propagates to the next lock P3, either.

Then, the winding former 40 is rotated by 180 degrees about the X-axis again, the stretch from the lock P3 to P4 is performed in nearly the same manner as with the stretch from the lock P1 to P2 in FIG. 3A described above. As a result, a next connecting conductor 16*s* is stretched into the state in FIG. 3D, completing a single round of winding.

Subsequently, the operations shown in FIGS. 3A–3D are repeated until the counters 70 and 72 indicate predetermined numbers of wind (numbers of turns) to end the winding operations.

As is evident from the foregoing description, in winding whichever effective conductor 14 or whichever connecting conductor 16, the conductive wire W is always locked to one of the locks P1–P4 when wound so as to bend at 90 degrees around the lock.

For that reason, despite the irregular-shape coil of special shape in which the two connecting conductors 16 are bent sharply in the same direction with respect to the effective conductors 14, both the effective conductors 14 and the connecting conductors 16 can be fed a new conductive wire W from the conductive wire feeding out machine 20 with the respective directions and angles optimum for winding. Therefore, the conductive wire W can be easily wound in order without increasing the winding tension excessively.

While the first and second rotating mechanisms 50 and 52 of the winding machine 30 rotate the winding former in the same directions all the time, the winding former 40 is thereby turned about the X-axis and the Y-axis alternately. Thus, in terms of rotation with respect to the wire W, the winding former 40 repeats the following four forms:

1) A forward rotation by 180 degrees about an axis parallel to the connecting conductors 16((*d*) to (*a*));

2) A forward rotation by 180 degrees about an axis parallel to the effective conductors 14((*a*) to (*b*));

3) A reverse rotation by 180 degrees about an axis parallel to the connecting conductors 16((*b*) to (*c*)); and 4) A reverse rotation by 180 degrees about an axis parallel to the effective conductors 14((*c*) to (*d*)).

After a single round of winding, the wire W twisted by the forward rotations is fully restored by the reverse rotations. This precludes torsion accumulation regardless of the number of wind.

Furthermore, as stated previously, new winding is always performed with little side force (torsional stress) occurring in the plane including the Z-axis and the effective conductors 14 or in the plane including the Z-axis and the connecting conductors 16. The conductive wire W therefore suffers little torsional stress between one lock and another, resulting in such a mode that torsion occurring at a predetermined lock hardly propagates to the next lock.

Now, return to FIGS. 10A–10C to reexamine the method of overlapping the coil sheets 3 (3*a*). In this method, for example, the flanges 8 for forming the connecting conductors 6 could not but have a thickness D greater than or equal to the thickness Wc of the effective conductors 4. In contrast, the single coil 12 fabricated by the method or device according to the embodiment may take a variety of shapes by selecting the dimensions of the first and second winding parts 42*a* and 44 (see D1, D2 in FIGS. 2A–2C and the number of turns. The lengths L1 and L2 of the effecting conductor portions 14 and the connecting conductors 16 may also be selected arbitrarily, and can be set freely without precluding the winding.

By the way, the method adopted in Japanese Patent Application Laid Open No. 2001-67955 belongs to ones generally referred to as "regular winding." The method of the present embodiment belongs to ones called as "random winding" (unless the feeding out position is controlled). The single coil 12 fabricated by winding the conductive wire W around the winding former 40 is not always low in the wire density of the effective conductors 14 (the space factor of the conductor) even as is. Nevertheless, a forming process can be given in the manner to be described below for a further improvement in the wire density of the effective conductors 14. As a result, it becomes possible to obtain a wire density comparable to that of the regular winding despite the random method.

Hereinafter, description will be given of the method for forming the single coil 12 wound thus and the method for forming or fabricating a coil unit for a linear motor with the single coil 12.

Figure 4:
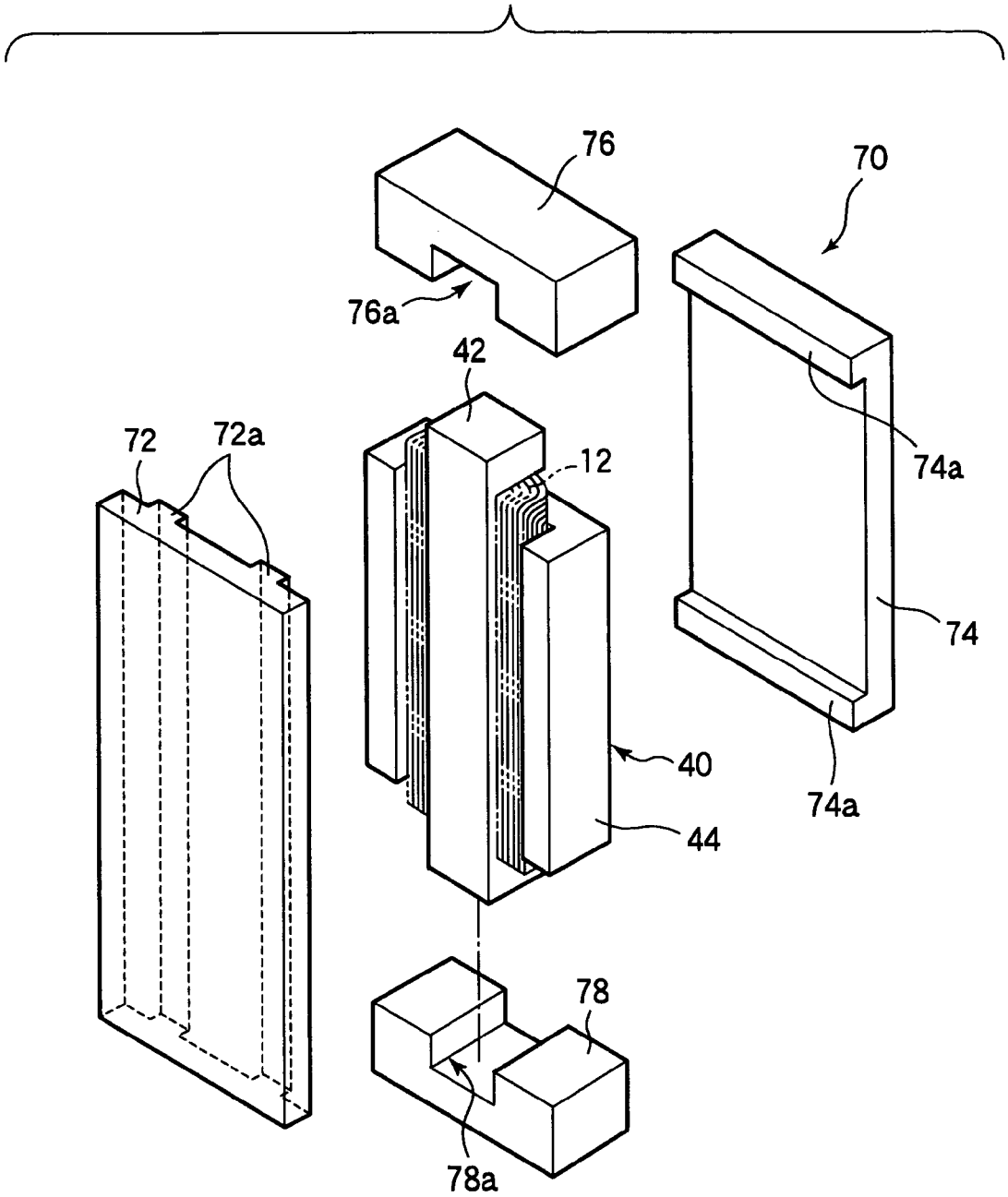
FIG. 4 is an exploded perspective view showing a forming tool in the above-mentioned embodiment.

The single coil 12 wound as described above is loaded into a forming tool 70 as still wound around the winding former 40. FIG. 4 shows this state.

The forming tool 70 comprises plates 72, 74, 76, and 78. The plates 72 and 74 sandwich the winding former 40 still having the single coil 12 wound around, from both sides in the direction corresponding to the Z-axis (as in the winding state). The plates 76 and 78 sandwich the winding former from both sides in the direction corresponding to the Y-axis. The plates 72, 74, 76, and 78 have protrusions 72*a* and 74*a* and recesses 76*a* and 78*a*, respectively, in conformity to the shape of the winding former 40. Incidentally, bolts and bolt holes for fastening are omitted from FIG. 4.

At first, the forming tool 70 is temporarily fastened to the winding former 40. In this state, a predetermined current is passed through the conductive wire W. The conductive wire W generates heat accordingly. When the conductive wire W rises in temperature up to a plastic range, the forming tool 70 is fastened further from the temporarily-fastened state. As a result, the conductive wire W in the plastic range can be formed into predetermined shape.

Moreover, the forming offers a single coil 12 that has no variation in the shapes and sizes of the effective conductors 14 and the connecting conductors 16.

Figures 5A, 5B, 5C:
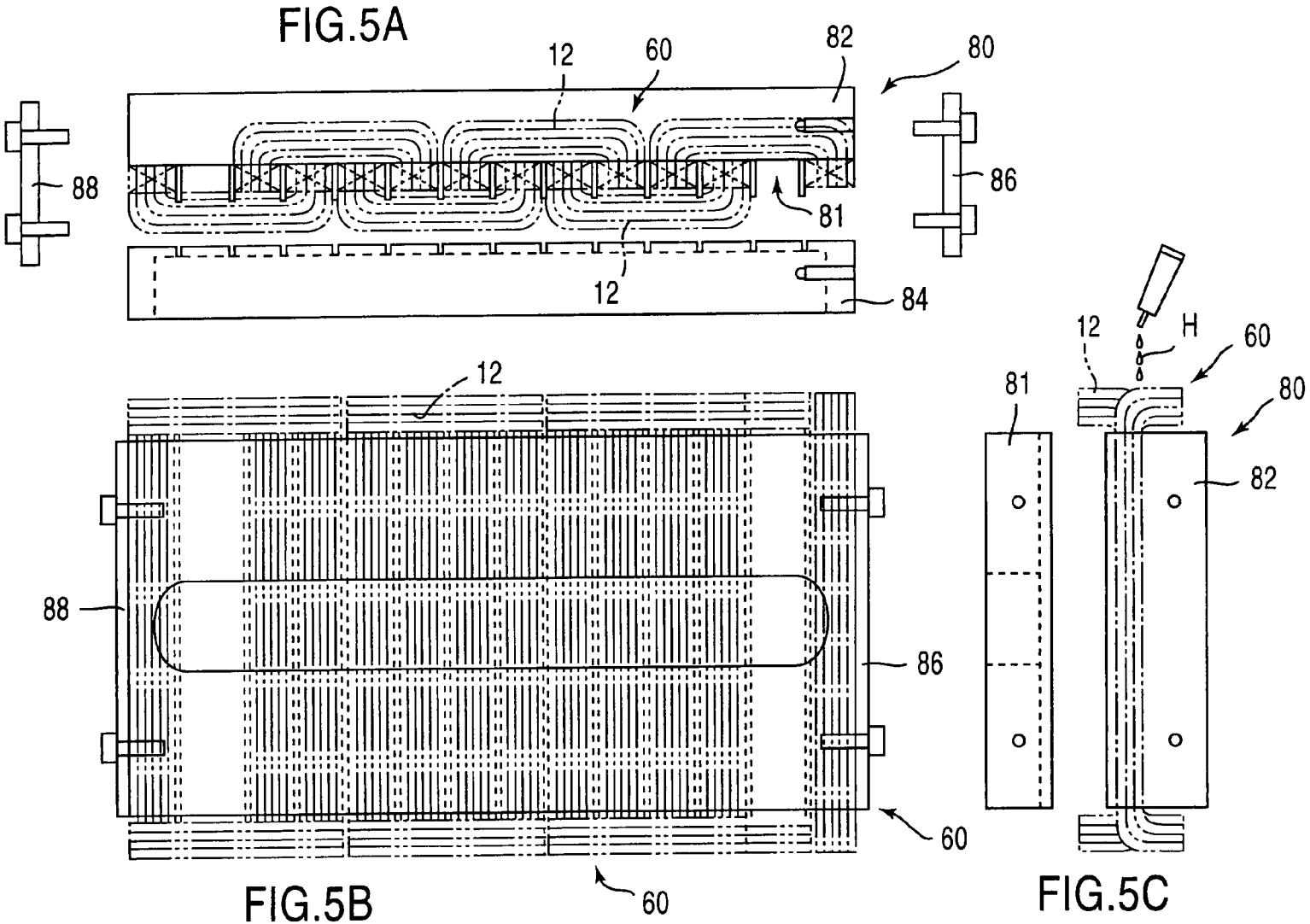
FIGS. 5A–5C illustrate a front view, a plan view, and a longitudinal sectional view, respectively, of a first forming device in the above-mentioned embodiment.

The single coil 12 formed thus is cooled and then released from the forming tool 70 and the winding former 40. In this manner, a plurality of single coils 12 are prepared. The single coils 12 prepared are loaded into a forming device 80 for a unit as shown in FIGS. 5A–5C, and fastened temporarily. The forming device 80 is composed of a pair of main bodies 82 and 84 each having grooves 81 for accommodating the single coils 12, and a pair of covers for enclosing both sides thereof. Here, the main bodies 82 and 84 hold the single coils 12 with no gap therebetween. The connecting conductors 16 are distributed to right and left alternately with respect to the traveling direction.

In this state, the single coils 12 are given predetermined connection. Incidentally, these single coils 12 are arranged and connected basically the same as those disclosed in Japanese Patent Application No. Laid Open No. 2001-67955 mentioned above (will be described later). After the connection, the connecting conductors 16 at the top and bottom of the coil unit 60 are fixed with an adhesive H.

Now, description will be given of another method for fabricating a coil unit 62 with the wound single coils 12.

In this method, the single coils 12 wound around the winding formers 40 are released as it is from the winding formers 40 without being formed by the forming tool 70 described above. The single coils 12 released are loaded into the grooves 81 of the forming device 80 shown in FIGS. 5A–5C, and fastened temporarily.

Figure 6:
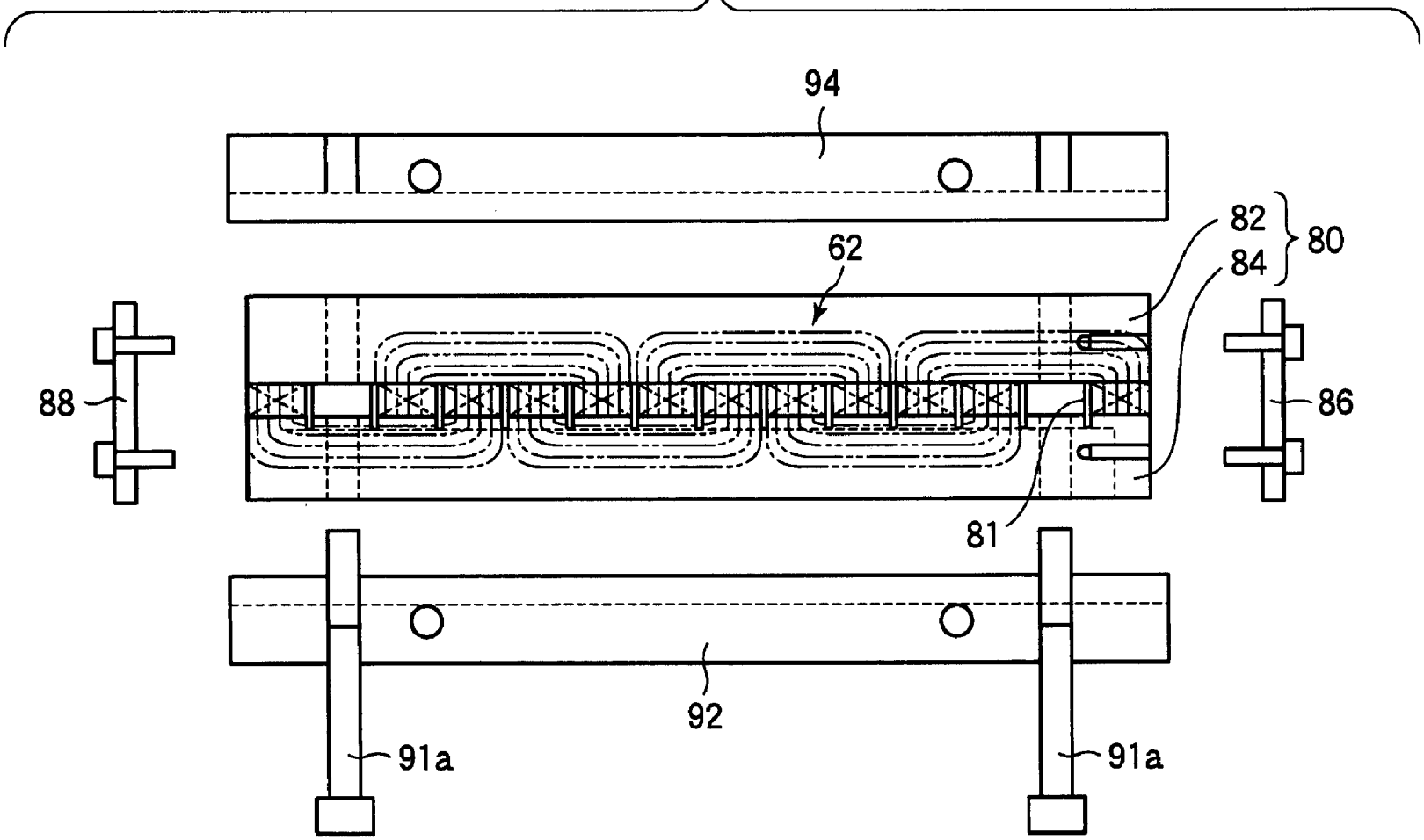
FIG. 6 is an exploded plan view showing the first forming device in another embodiment, combined with a second forming device.
Figure 7B:
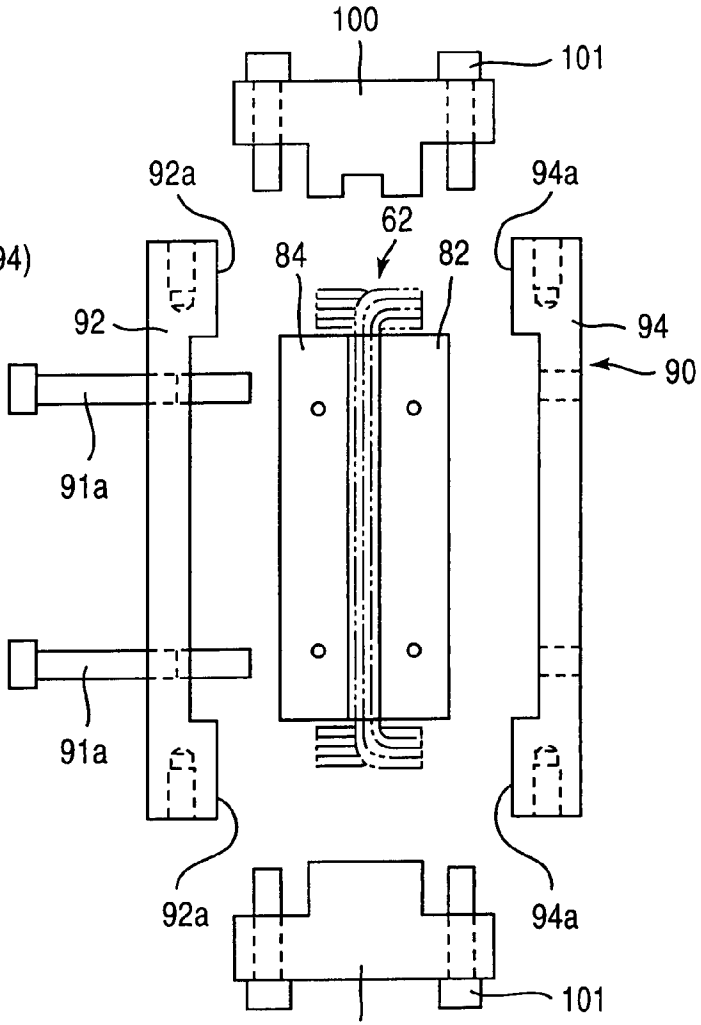
FIGS. 7A–7B illustrate exploded front and side views, respectively, of the first forming device shown in FIG. 6 combined with an additional forming tool.
Figure 7A:
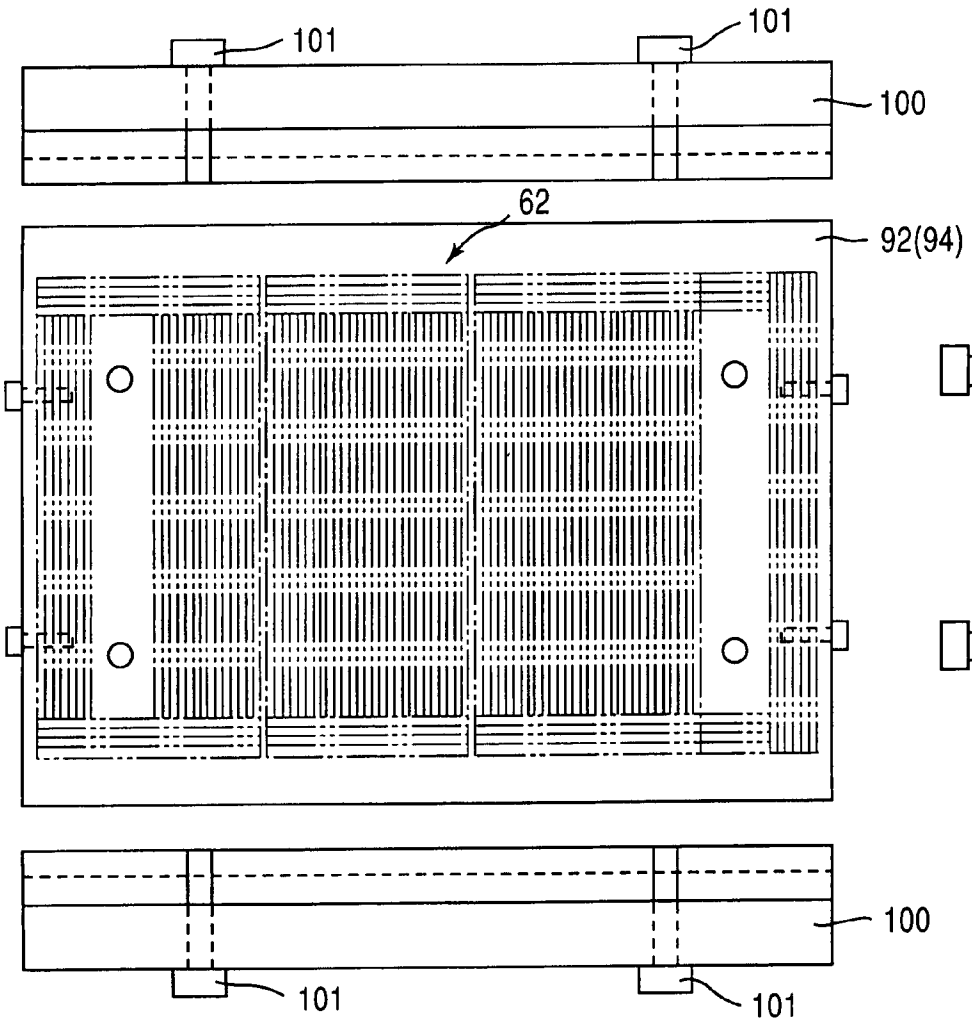

Thereafter, the single coils 12 are connected according to the specifications of the coil unit 62, and loaded into such a second forming device 90 as shown in FIGS. 6 and 7A–7B for temporary fastening.

The second forming device 90 is composed of plates 92 and 94 for sandwiching the coil unit along with the first forming device 80 from right and left sides of the traveling direction. The second forming device 90 is configured attachable to the first forming device 80 with bolts 91*a*. The plates 92 and 94 have protrusions 92*a* and 94*a*, respectively, in consideration of the shapes of the first forming device 80 and the single coils 12.

At first, the second forming device 90 is attached merely by temporary fastening. In this state, a predetermined current is passed through the conductive wires W of the respective single coils 12. When the conductive wires W rise in temperature up to the plastic range, the first and second forming devices 80 and 90 are fastened further from the temporary-fastened state to form the conductive wires W in the plastic range into predetermined configuration. Finally, forming tools 100 are fitted thereto from above and below for compression to a predetermined size with bolts 101. After cooled, the forming tool 100 and the second forming device 90 are removed, and the connecting conductors 16 are fixed with an adhesive.

In either case, the plurality of single coils 12 are eventually loaded into a resin mold by themselves, and set in required shape.

Finally, description will be given of the constitution and operation of the coil unit 60 (62) for the case of making a linear motor LM.

Figure 8A:
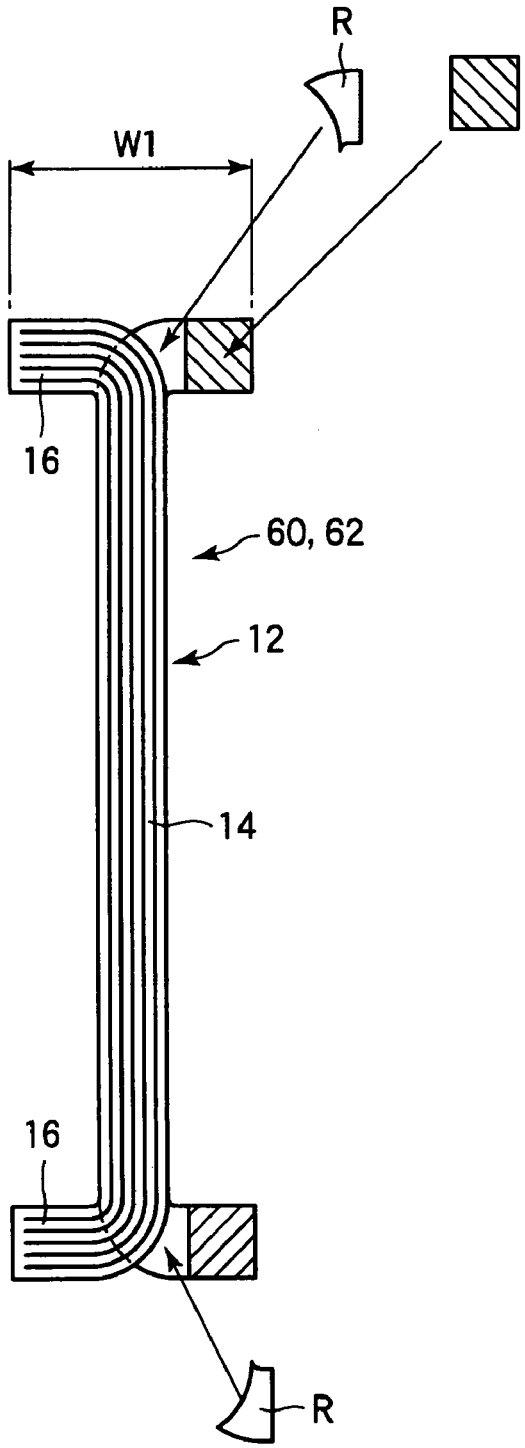
FIGS. 8A–8B illustrate longitudinal sectional views of a coil unit.
Figure 8B:
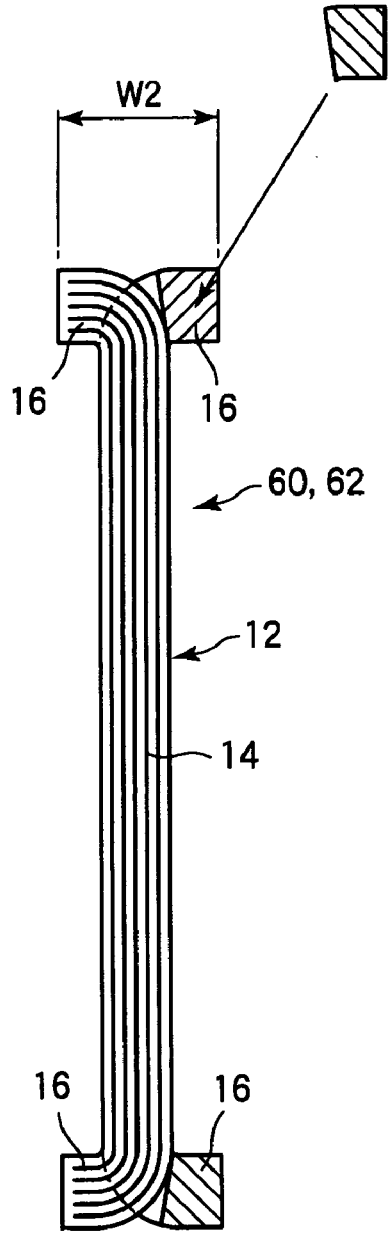
Figure 9:
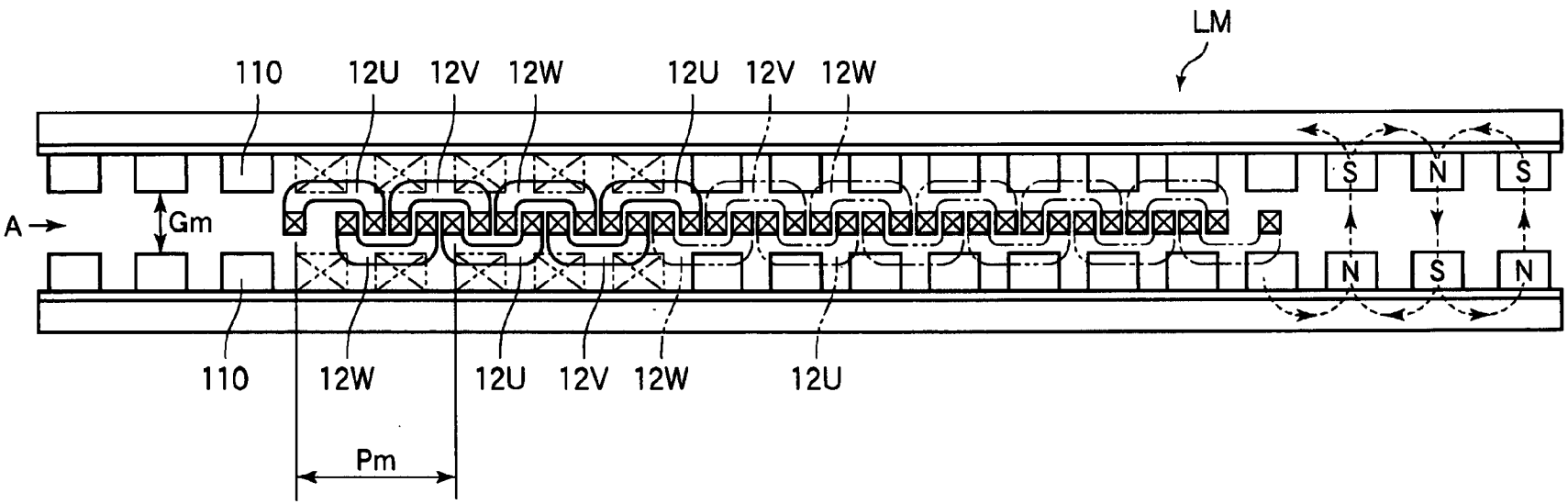
FIG. 9 is a plan view showing a coil unit and a magnet unit for a linear motor according to the present invention.

Referring to FIGS. 8A and 8B through 9 and returning to FIGS. 10A–10C, a plurality of single coils 12 are used as single coils 12U, 12V, and 12W for U, V, and W phases, respectively. These three-phase single coils 12 are assembled in the following manner. Initially, two single coil groups are prepared. In each group, single coils 12 are arranged so that their effective conductors 14 adjoin one another with no gap between the outer sides thereof. The connecting conductors 16 are bent in opposite directions across the traveling direction A (in FIG. 9, the single coil group arranged above in an inversed U-shape and the single coil group arranged below in a U-shape). Then, the single coils 12 in the respective groups are opposed to each other so that the opening of each effective conductor 14 of one group accommodates ends of two effective conductors 14 of the other group. The result is that the effective conductors 14 are arranged at a regular pitch. Here, as shown in FIG. 9, the single coils in one group are arranged in the order of U, V, W, U, V, W, . . . , and the single coils in the other group are also arranged in the order of U, V, W, U, V, W, . . . . Then, both the single coil groups are adjusted in phase so that ends of V- and W-phase effective conductors 14 of one group lie between the effective conductors 14 of the U-phase single coils 12 of the other group.

As a result, the cross sections of the U-, V-, and W-phase effective conductors 14 come in succession along the traveling direction. This arrangement is achieved by the use of the single coils 12 that have the connecting conductors 16 bent at approximately 90 degrees with respect to the effective conductors 14. Merely two phases of coils will appear as seen in a cross section perpendicular to the traveling direction (see FIGS. 8A–8B. This arrangement is extremely advantageous since no more than a single type of single coils 12 is needed.

As mentioned previously, in this embodiment, the first winding parts 42*a* of the first piece 42 of the winding former 40 are sloped away from the second pieces 44 toward the ends of the first winding parts 42*a*. In the absence of these slopes, interference with adjoining single coils 12 would be inevitable unless the connecting conductors 16 had a considerably great right-to-left width W1 with respect to the traveling direction as shown in FIG. 8A. Then, the presence of the slopes allows compact accommodation with no wasted regions R as shown in FIG. 8B. As a result, the width W1 can be reduced down to the width W2. This reduction contributes to a reduced right-to-left width with respect to the traveling direction of the linear motor LM. At a given width, the casing can be made with a greater thickness for stabler moving. Depending on the design, greater thrust can be produced.

Returning to FIG. 9, for the fixed side of the linear motor LM, magnets 110 are used to distribute magnetic flux of approximately sine shape along the center line of the magnet array. Assuming that the coordinate along the center line of the magnet array is z, the magnetic flux density B(z) at each point of the coordinate is given by the following equation:

$$B(z)=B_0 \sin(\pi z/Pm). \quad (1)$$

Where Pm is pole pitch. When the currents through the U-, V-, and W-phase coils are changed in intensity so as to coincide with the phases of the magnetic flux densities where the centers of the respective phases lie, the coil unit 60 (62) produces a constant thrust all the time irrespective of the relative positions between the single coils 12 and the magnetic array. Suppose, for example, that the intensities of the currents at the centers of the U, V, and W phases are expressed as functions of z and controlled to be $I_0 \cdot \sin(z/Pm)\pi$, $I_0 \cdot \sin(z/Pm+2/3)\pi$, and $I_0 \cdot \sin(z/Pm+4/3)\pi$, respectively, and the effective conductors 14 of the single coils 12 have a length of L1. Then, the per-pole thrust F(z) of the coil is given by $F(z)=1.5B_0I_0L1$. This equation involves no factor related to the coordinate z. Namely, it shows that a constant thrust can be obtained irrespective of the coordinate z.

When the pole pitch Pm alone is rendered variable and the other parameters such as the inter-magnet distance Gm are kept constant, the maximization of the effective magnetic flux density requires that the ratio of the pole pitch Pm to the inter-magnet distance Gm, or Pm/Gm, be on the order of 4 to 5. The technology disclosed in Japanese Patent Application Laid Open No. 2001-67955 achieves a ratio of 2.7 or so. Assuming that this ratio is 4.1, or 1.5 times as much, the effective magnetic flux density across the coils also becomes approximately 1.5 times. Here, if the effective conductors 14 fill the pole pitch with no gap therebetween, the single coils 12 also become 1.5 times in number.

This also makes the coil resistances 1.5 times, however. At a given driver supply voltage, the maximum possible current decreases to $1/1.5$ times with no change in $I_0L1$. The result is that while the thrust becomes 1.5 times, the width W2 of each connecting conductor 14 (see FIGS. 8A–8B) also becomes 1.5 times for poor accommodation. Now, if the cross-sectional areas of the windings can be increased 1.5 times for nearly the same space factor, $I_0$ can be rendered 1.5 times at a given L1. In this case, the thrust becomes the square of 1.5, or 2.25 times.

Using the method of the present invention significantly facilitates modifying the cross-sectional area of the conductive wire W and the number of windings according to the coil specifications. In addition, the combination with such a forming method as described above allows closer contact between the single coils 12. Therefore, the connecting conductors 16 can be minimized in width W2. Furthermore, the conductive wire W may be a marketable round wire (conductive wire having a round cross section), which contributes to cost reduction.

According to the present invention, it is possible to provide a technology for allowing even a type (form) of single coil such that a pair of connecting conductors thereof are bent sharply in the same direction with respect to the effective conductors to be fabricated by winding a single conductive wire (instead of laminating coils sheets). As a result, it becomes possible to provide a low-cost, easy-to-redesign single coil and a coil unit utilizing the same.

What is claimed is:

1. A method for winding a single coil of a coil unit for a linear motor, the single coil having a substantially rectangular ring shape and comprising a conductive wire, the method comprising the steps of:

feeding out the conductive wire in a direction of a Z-axis, a winding former being positioned with a center at a point of origin on X- and Y-axes, wherein the X- and Y-axes are each orthogonal relative to each other and the Z-axis, the winding former having a plurality of locks for a the conductive wire at positions corresponding to vertices of the substantially rectangle ring shaped coil and functioning as a base in winding the conductive wire into the substantially rectangular ring shape;

a first rotating step of rotating the winding former 180 degrees about the Y-axis while locking the conductive wire fed in the direction of the Z-axis to a first lock of the plurality of locks;

a second rotating step of rotating the winding former by 180 degrees about the X-axis after the conductive wire is locked to a second lock of the plurality of locks at the end of the first rotating step;

a third rotating step of rotating the winding former 180 degrees about the Y-axis after the conductive wire is locked to a third lock of the plurality of locks at the end of the second rotating step; and a fourth rotating step of rotating the winding former 180 degrees about the X-axis after the conductive wire is locked to a fourth lock of the plurality of locks at the end of the third rotating step, the first through fourth rotating steps being repeated to successively wind the conductive wire around the winding former.

* * * * *

UNITED STATES PATENT AND TRADEMARK OFFICE

CERTIFICATE OF CORRECTION

PATENT NO. : 7,082,674 B2
APPLICATION NO. : 10/678134
DATED : August 1, 2006
INVENTOR(S) : Hidehiko Mori et al.

It is certified that error appears in the above-identified patent and that said Letters Patent is hereby corrected as shown below:

Please change the following information:

(75) "Hidehiko Mori, Hachiouji (JP);"
"Yasushi Koyanagawa, Isehara (JP);"
"Yoshiyuki Tomita, Hiratsuka (JP)"

TO

--Hidehiko Mori, Tokyo (JP);--
--Yasushi Koyanagawa, Kanagawa (JP);--
--Yoshiyuki Tomita, Kanagawa (JP)--

Signed and Sealed this

Twenty-eighth Day of August, 2007

JON W. DUDAS
*Director of the United States Patent and Trademark Office*